US005930933A

United States Patent [19]

Schleicher

[11] Patent Number: 5,930,933

[45] Date of Patent: Aug. 3, 1999

[54] RIFLE SUPPORT STAND

[76] Inventor: Richard H. Schleicher, 1130 Morris La., Slatington, Pa. 18080

[21] Appl. No.: 09/143,745

[22] Filed: Aug. 31, 1998

[51] Int. Cl.[6] ..... F41A 27/30

[52] U.S. Cl. ..... 42/94

[58] Field of Search ..... 42/94

[56] References Cited

U.S. PATENT DOCUMENTS

| | | | |
|---|---|---|---|
| D. 346,003 | 4/1994 | Anderson . | |
| D. 359,337 | 6/1995 | Banfill . | |
| 2,847,909 | 8/1958 | Kester | 42/94 |
| 3,863,376 | 2/1975 | Dalmaso | 42/94 |
| 3,947,988 | 4/1976 | Besaw . | |
| 4,501,082 | 2/1985 | Phillips et al. | 42/94 |
| 4,802,612 | 2/1989 | Anderson . | |
| 4,854,066 | 8/1989 | Canterbury, Sr. . | |
| 4,893,427 | 1/1990 | Davidson . | |
| 5,317,826 | 6/1994 | Underwood | 42/94 |
| 5,406,732 | 4/1995 | Peterson | 42/94 |
| 5,507,111 | 4/1996 | Stinson et al. | 42/94 |

*Primary Examiner*—Charles T. Jordan
*Assistant Examiner*—Denise J Buckley
*Attorney, Agent, or Firm*—Bell, Boyd & Lloyd

[57] ABSTRACT

The present invention reveals a portable, collapsible and adjustable rifle support stand which supports a rifle at each end—under the barrel and under the stock. The support stand is made of two vertical supports for the rifle. The rear or stock support is a collapsible tripod and the front or barrel support is a collapsible bipod. The front and rear support of the rifle support stand can be adjusted up or down relative to the position of the ground. The support stand is designed to steady a telescope-equipped rifle for more accurate shooting.

10 Claims, 2 Drawing Sheets

RIFLE SUPPORT STAND

BACKGROUND OF THE INVENTION

1. Field of the Invention

The present invention discloses a portable, collapsible and adjustable rifle support stand which supports a rifle at each end—under the barrel and under the stock. The support stand is made of two vertical supports for a rifle. The rear or stock support is a hinged tripod and the front or barrel support is a hinged bipod. The rifle support stand is designed to steady a telescope-equipped rifle for more accurate shooting.

2. Description of the Related Art

When shooting a rifle, many hunters and target shooters use one hand and forearm to support the rifle barrel and the other arm and shoulder to support the rifle stock. However, there is always some wobble of the rifle and therefore reduction of target accuracy with this method. At 200 to 300 yards distance from a target, even the slightest movement of the human body, and hence the rifle, can cause a large reduction in target accuracy.

In order to overcome the shortcomings of this hand holding method, many hunters and target shooters use a barrel support when shooting rather than using their hand and forearm to support the rifle barrel. However, the fact that the other arm and shoulder are used to support the rifle stock still causes some wobble and hence a reduction in target accuracy. In the field, a hunter may position his rifle on a convenient tree branch, rock or the like to shoot more accurately, but the rear support of the rifle, i.e., the arm and shoulder, can and does decrease target accuracy.

Numerous inventions have been developed to overcome the disadvantages of the hand holding shooting method and/or the barrel support methods. For example, U.S. Pat. No. 3,947,988 (Besaw) discloses a portable rifle rest useful for zeroing in rifles on or off a rifle range. The rifle rest includes an elongated, upper rifle support block provided with a V-shape rifle support notch therein lined with cushioning material and two elongated lower foot blocks each pivotally mounted to the upper block to move between positions at right angles thereto when the rifle rest is in use and positions aligned therewith when the rifle rest is to be transported like a suitcase. However, the rifle rest has limited adjustability and collapsibility.

U.S. Pat. No. 4,802,612 (Anderson) discloses a sporting apparatus support device for the handicapped having a front support plate and a back support plate which are adjustably attached to each other with belts so as to securely sandwich the wearer. An across-the-shoulder strap extending from the front support plate to the back support plate is also provided and an outwardly and upwardly extending bar from the front support plate is provided for attaching a gun rest. However, this device is not collapsible or adjustable.

U.S. Pat. No. 4,854,066 (Canterbury, Sr.) discloses and adjustable rifle rest. The adjustable rifle rest includes a cylindrical standard implantable into the ground, a rotatable yoke mounted on the upper end of the standard, a sleeve snugly but rotatably and slidingly engaging the shoulder, a member having a horizontal portion with one end fixed to the sleeve and the other end terminating in an upwardly extending vertical portion, a fixed yoke mounted on the upper end of the vertical portion of the member, a structure affixed to the lower end of the standard to aid in implanting the standard and an assembly operable to vary the length of the standard. However, this rifle rest is not collapsible and must be implanted in the ground.

U.S. Pat. No. 4,893,427 (Davidson) discloses a firearm support which can be quickly and easily set up. The firearm support securely supports a firearm, such as a rifle, while permitting the firearm to have freedom of movement in several planes. The support also can be stored adjacent to the firearm without tangling the shoulder strap associated with the firearm. However, this firearm support has limited adjustability.

Finally, design Pat. No. D346,003 (Anderson) discloses a portable rifle rest and design Pat. No. D359,337 (Banfill) discloses a collapsible rifle rest. However, each of these rifle rests has limited adjustability.

It is, therefore, an object to the present application to provide a portable, collapsible and adjustable rifle support stand which is both simple to use and relatively inexpensive to produce.

SUMMARY OF THE INVENTION

The present invention discloses a rifle support stand made up of a front support and a rear support. The front support has at least two front support legs, each front support leg having an upper end and a lower end, and a barrel cradle, where the barrel cradle is pivotally connected to an upper end of each of the at least two front support legs. The rear support has at least three rear support legs, each rear support leg having an upper end and a lower end, where the rear support legs form a tripod having at least two forward positioned rear support legs and at least one rearward positioned rear support leg, and a stock cradle. The stock cradle is pivotally connected to the upper end of each of the at least two forward positioned rear support legs and the stock cradle is hingedly connected to the upper end of the at least one rearward positioned rear support leg. The lower end of each of the at least two front support leg is hingedly connected to the lower end of one of the at least two forward positioned rear support legs.

In a preferred embodiment, the rifle support stand has a control cord connecting a front support leg and each of the forward positioned rear support legs. In other preferred embodiments, the barrel cradle is padded, the stock cradle is padded or the barrel cradle and the stock cradle are padded. In a more preferred embodiment, the barrel cradle is covered with a soft plastic coating.

In other preferred embodiments, the control cord comprises a plastic rope, the front support legs comprise hardwood slats, the rear support legs comprise hardwood slats or the front support legs and the rear support legs comprise hardwood slats. In a more preferred embodiment, the lower end of each of the at least two front support legs is hingedly connected to the lower end of one of the at least two forward positioned rear support legs with a piece of flexible plastic.

DETAILED DESCRIPTION OF THE PREFERRED EMBODIMENT

The present invention discloses a portable, collapsible and adjustable rifle support stand which supports a rifle at each end—under the barrel and under the stock. The support stand is made of two vertical supports for a rifle. The rear or stock support is an adjustable and collapsible tripod and the front or barrel support is an adjustable and collapsible bipod. The rifle support stand is designed to steady a telescope-equipped rifle for more accurate shooting.

Figure 1:
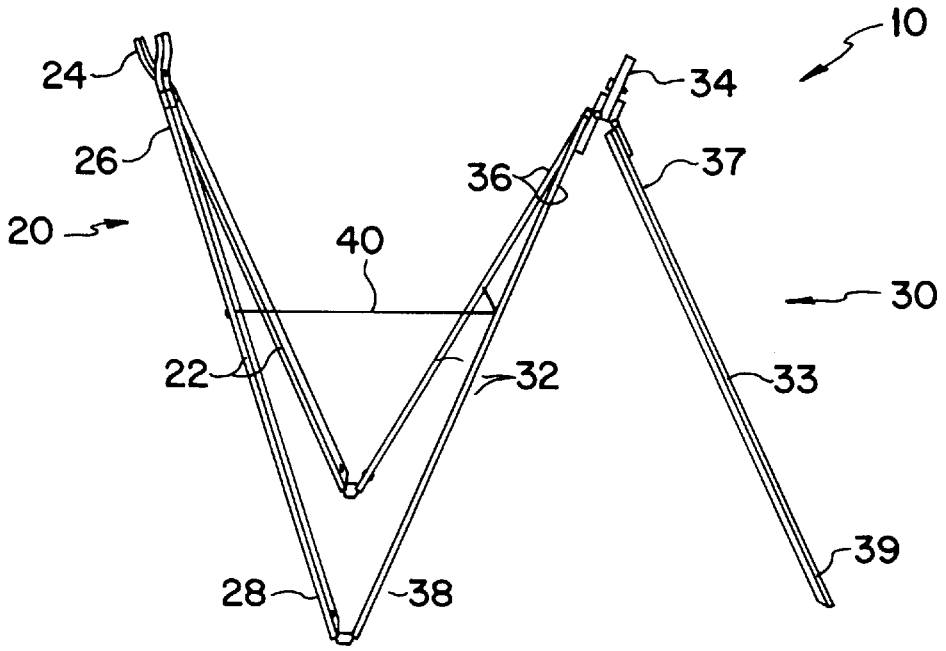
FIG. 1 shows the portable, collapsible and adjustable rifle support stand of the present application in an extended position.
Figure 3:
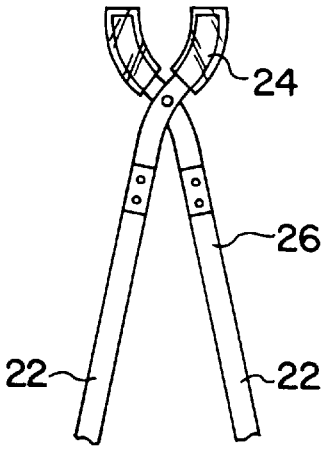
FIG. 3 shows the pivot connection of the barrel cradle to the upper end of each of the front support legs of the rifle support stand.

More specifically and as shown in FIG. 1, the front support 20 of the rifle support stand 10 has at least two front support legs 22 and a barrel cradle 24. Each front support leg 22 has an upper end 26 and a lower end 28. The lower end 28 of each front support leg 22 contacts the ground. The barrel cradle 24 is pivotally connected to the upper end 26 of each front support leg 22. FIG. 3 shows the pivot connection of the barrel cradle 24 to the upper end 26 of each of the front support legs 22 of the rifle support stand.

The rear support 30 of the rifle support stand 10 has at least three rear support legs, at least two forward positioned rear support legs 32 and at least one rearward positioned rear support leg 33, and a stock cradle 34. Each forward positioned rear support leg 32 has an upper end 36 and a lower end 38 and the rearward positioned rear support leg 33 has an upper end 37 and a lower end 39. The lower end 38 of each of the forward positioned rear support legs 32 and the lower end 39 of the rearward positioned rear support leg 33 contact the ground. The stock cradle 34 is connected to the upper end 36 of each forward positioned rear support leg 32 and to the upper end 37 of the rearward positioned rear support leg 33 so that the rear support legs 32 and 33 form a tripod. Thus, the rear support 30 has at least two forward positioned rear support legs 32 and at least one rearward positioned rear support leg 33.

Figure 4:
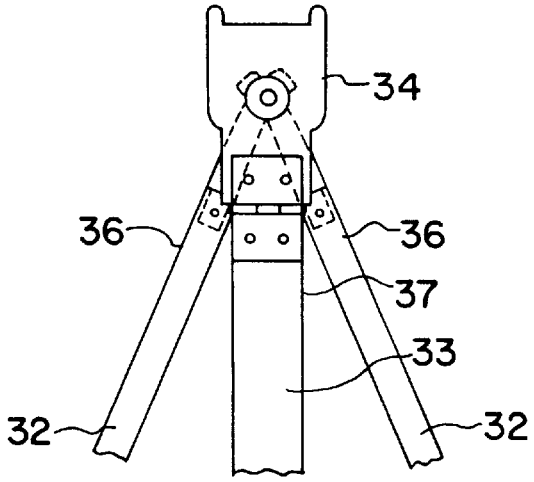
FIG. 4 shows the pivot connection of the stock cradle to the upper end of each of the two forward positioned rear support legs and the hinged connection of the stock cradle to the upper end of the rearward positioned rear support leg.

The stock cradle 34 is pivotally connected to the upper end 36 of each of the two forward positioned rear support legs 32 and the stock cradle 34 is hingedly connected to the upper end 37 of the rearward positioned rear support leg 33. FIG. 4 shows the pivot connection of the stock cradle 34 to the upper end 36 of each of the two forward positioned rear support legs 32 and the hinged connection of the stock cradle 34 to the upper end 37 of the rearward positioned rear support leg 33.

Figure 5:
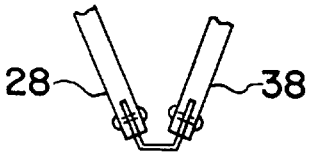
FIG. 5 shows the hinged connection between the lower end of one of the front support legs and the lower end of one of the forward positioned rear support legs.

The lower end 28 of each front support leg 22 is hingedly connected to the lower end 38 of one of the forward positioned rear support legs 32. FIG. 5 shows the hinged connection between the lower end 28 of one of the front support legs 22 and the lower end 38 of one of the forward positioned rear support legs 32. The rifle support stand 10 also has a control cord 40 connecting a front support leg 22 and each of the forward positioned rear support legs 32.

The portable, collapsible and adjustable rifle support stand 10 of the present application is shown in FIG. 1 in an extended position. The front support legs 22 of the front support 20 are adjustable so that they can be extended outward to lower the height of the barrel cradle 24 or they can be collapsed inward to increase the height of the barrel cradle 24 relative to that of the ground. Since the lower end 28 of each front support leg 22 is hingedly connected to the lower end 38 of one of the forward positioned rear support legs 32, adjustment of the front support legs 22 will produce a corresponding adjustment in the rear support 30.

Likewise, the rear support legs 32 and 33 of the rear support 30 are adjustable so that they can be extended outward to lower the height of the stock cradle 34 or they can be collapsed inward to increase the height of the stock cradle 34 relative to that of the ground. Since the lower end 38 of each of the forward positioned rear support legs 32 is hingedly connected to the lower end 28 of one of the front support legs 22, adjustment of the forward positioned rear support legs 32 will produce a corresponding adjustment in the front support 20.

In addition, the rearward positioned rear support leg 33 is separately adjustable so that it can be extended outward to lower the height of the stock cradle 34 or it can be collapsed inward to increase the height of the stock cradle 34 relative to that of the ground. Furthermore, the rearward positioned rear support leg 33 can be adjusted from side to side without changing the height of the stock cradle 34 relative to that of the ground. This side to side adjustment of the rearward positioned rear support leg 33 will compensate for an uneven surfaces on the ground.

The rifle support stand 10 also has a control cord 40 connecting a front support leg 22 and each of the forward positioned rear support legs 32. The control cord 40 passes through an opening in each of the legs and controls and limits the adjustment of the front support leg 22 relative to that of the forward positioned rear support legs 32 and the adjustment of the forward positioned rear support legs 32 relative to each other, simultaneously. In other words, the control cord 40 simultaneously controls and limits the adjustment of the front support leg 22 relative to that of the forward positioned rear support legs 32 and the adjustment of the forward positioned rear support legs 32 relative to each other.

Thus, the rear support 30 of the rifle support stand 10 is in a tripod shape with each leg 32 and 33 connected to the other such that the legs can be pulled out or folded in. Tripods are inherently stable on any surface so by positioning the legs any barrel angle or height can be achieved. The top of the tripod, i.e, the stock cradle 34, is padded to accommodate the stock of a rifle.

Figure 2:
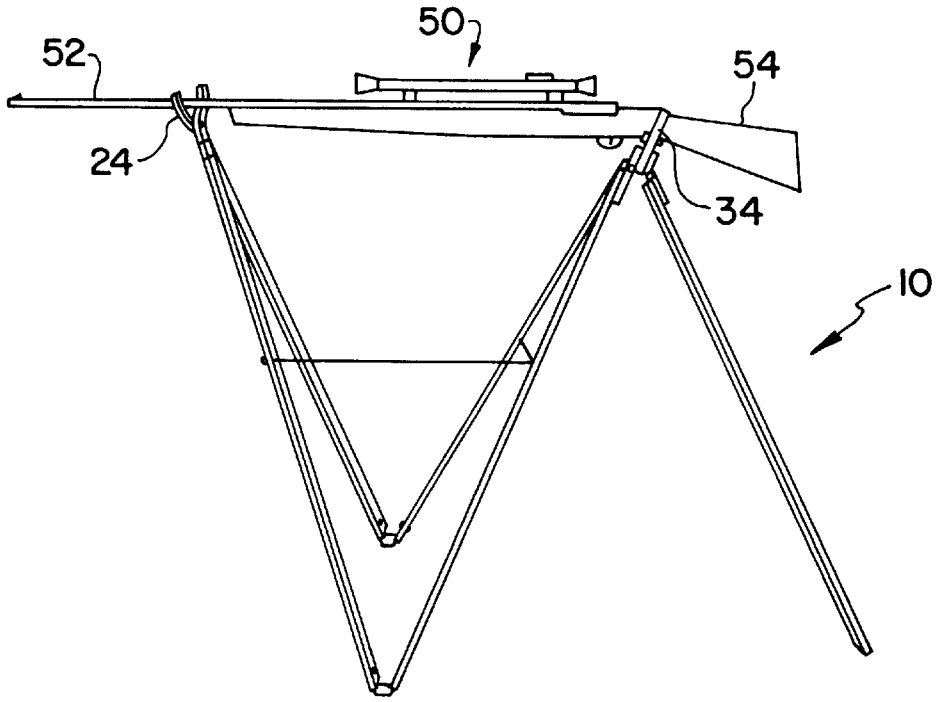
FIG. 2 shows the portable, collapsible and adjustable rifle support stand of the present application in an extended position with a rifle in place. The barrel of the rifle is in contact with the barrel cradle of the rifle support stand and the stock of the rifle is in contact with the stock cradle of the rifle support stand.

The support stand 10 can, therefore, be positioned on hills such that the barrel of a rifle can point up or down hill or on even terrain where the legs 22, 32 and 33 can be quickly adjusted to line up with the target. FIG. 2 shows the portable, collapsible and adjustable rifle support stand 10 of the present application in an extended position with a rifle 50 in place. The barrel 52 of the rifle is in contact with the barrel cradle 24 of the rifle support stand 10 and the stock 54 of the rifle is in contact with the stock cradle 34 of the rifle support stand 10.

Figure 6:
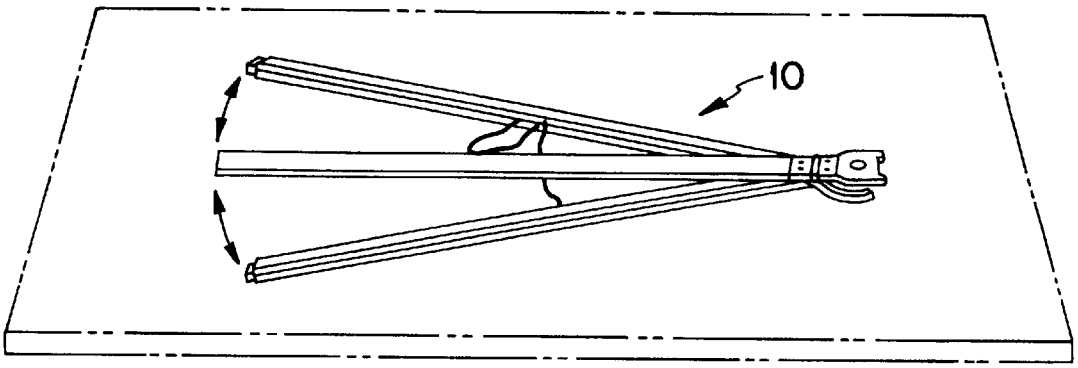
FIG. 6 shows the portable, collapsible and adjustable rifle support stand of the present application in a collapsed position.

Because the legs 22, 32 and 33 of the rifle support stand 10 are pivotally and/or hingedly connected, they fold up, a feature that makes them easy to store and to transport. FIG. 6 shows the portable, collapsible and adjustable rifle support stand 10 of the present application in a collapsed position. A collapsed rifle support stand 10 is easily portable.

The rifle support stand can be made of any material strong enough to support the weight of a rifle. Thus, the front support legs and the rear support legs can be made of wood, plastic or metal. Likewise, the barrel cradle and the stock cradle can be made of wood, plastic or metal. In a preferred embodiment of the present invention, each of the cradles will be padded so as not to scratch the rifle barrel or stock. Any soft material, natural or artificial or combination thereof, may be used for the padding. In a preferred embodiment, the front support is padded or coated with a soft plastic.

The control cord may be made of any material, such as natural fibers, artificial fibers or flexible metals, strong enough and flexible enough to limit the movement, and hence the adjustment, of the support legs. Examples of suitable materials for the control cord include cotton rope, hemp rope, plastic rope, and metal springs.

In a preferred embodiment of the present invention, the front support legs are made of two pieces of hinged hardwood slats bolted to two ⅛-inch, cradle-shaped sections of steel with a jam nut and bolt between the two sections that serves as a pivot point. Sheet metal is used on the upper section of the wooden slats to assist in holding the metal plate in place.

In a preferred embodiment the lower end of each front support leg is hingedly connected to the lower end of one of the forward positioned rear support legs with a piece of flexible plastic. The hinged connected may also be made with a conventional metal hinge or a comparable shaped plastic hinge.

Overall, the front support looks like a long pair of pliers with the jaws covered with plastic strips to prevent scratching of the rifle barrel. In a preferred embodiment, the support is 4 feet in height with the legs 4 feet apart when not closed together for transport or storage. It should be noted that the length of the support legs and thus the height of the support stand can be varied in length depending upon the specific application by the user. For example, the length of the support legs may be increased and thus the height of the support stand rifle increased for use by a shooter in an erect position. In the same way, the length of the support legs may be decreased and thus the height of the support stand rifle decreased for use by a shooter in a prone position. In other words, the rifle support stand can be manufactured in different heights, by changing the length of each support leg, to accommodate hunters lying down, sitting or even standing up.

Figure 7:
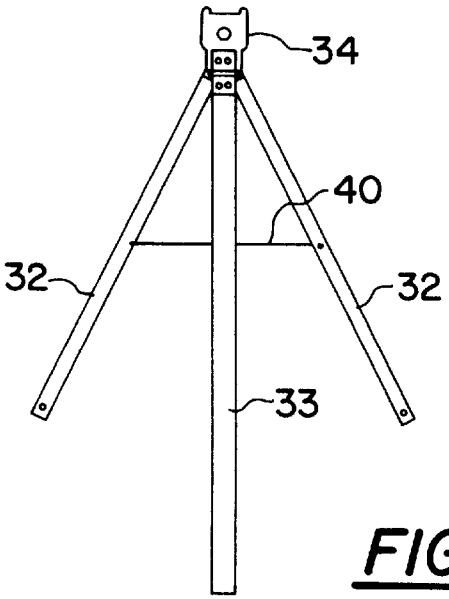
FIG. 7 shows a rear view of the portable, collapsible and adjustable rifle support stand of the present application in an extended position.

The rear support is in a tripod shape with each leg connected to the others such that the legs can be pulled out or folded in. Tripods are inherently stable on any surface so by positioning the legs any barrel angle or height can be achieved. The top of the tripod is padded to accommodate the stock. FIG. 7 shows a rear view of the portable, collapsible and adjustable rifle support stand of the present application in an extended position.

The tripod can, therefore, be positioned on hills such that the barrel can point up or down hill and on even terrain where the legs can be quickly adjusted to line up with the target. Because the legs are hinged and/or pivoted, they are collapsible and can fold up, a feature that makes them easy to store and to transport.

While the invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the appended claims.

Thus, it is to be understood that variations in the present invention can be made without departing from the novel aspects of this invention as defined in the claims. All patents and articles cited herein are hereby incorporated by reference in their entirety and relied upon.

What is claimed is:

1. A rifle support stand, comprising a) a front support having i) at least two front support legs, each front support leg having an upper and a lower end, and ii) a barrel cradle, wherein the barrel cradle is pivotally connected to an upper end of each of the at least two front support legs; and b) a rear support having i) at least three rear support legs, each rear support leg having an upper and a lower end, whereby the rear support legs form a tripod having at least two forward positioned rear support legs and at least one rearward positioned rear support leg and ii) a stock cradle, wherein the stock cradle is pivotally connected to the upper end of each of the at least two forward positioned rear support legs and the stock cradle is hingedly connected to the upper end of the at least one rearward positioned rear support leg, wherein the rearward positioned rear support leg can be adjusted from side to side without changing the height of the stock cradle, wherein the lower end of each of the at least two front support legs is hingedly connected to the lower end of one of the at least two forward positioned rear support leg.

wherein a control cord connects a front support leg and each of the forward positioned rear support legs, and wherein the control cord controls the angle of the front support leg and the forward positioned rear support legs, and limits adjustment of the front support leg relative to that of the forward positioned rear support legs and adjustment of the forward positioned rear support legs relative to each other, simultaneously.

2. The rifle support stand of claim 1, wherein the barrel cradle is padded.

3. The rifle support stand of claim 1, wherein the stock cradle is padded.

4. The rifle support stand of claim 1, wherein the barrel cradle and the stock cradle are padded.

5. The rifle support stand of claim 1, wherein the barrel cradle is covered with a soft plastic coating.

6. The rifle support stand of claim 1, wherein the control cord comprises a plastic rope.

7. The rifle support stand of claim 1, wherein the front support legs comprise hardwood slats.

8. The rifle support stand of claim 1, wherein the rear support legs comprise hardwood slats.

9. The rifle support stand of claim 1, wherein the front support legs and the rear support legs comprise hardwood slats.

10. The rifle support stand of claim 1, wherein the lower end of each of the at least two front support legs is hingedly connected to the lower end of one of the at least two forward positioned rear support legs with a piece of flexible plastic.

* * * * *